US007279070B2

(12) United States Patent
Snekkenes et al.

(10) Patent No.: US 7,279,070 B2
(45) Date of Patent: Oct. 9, 2007

(54) METHOD FOR THE CONTINUOUS COOKING OF WOOD RAW MATERIAL FOR CELLULOSE PULP

(75) Inventors: Vidar Snekkenes, Karlstad (SE); Lennart Gustavsson, Karlstad (SE)

(73) Assignee: Metso Fiber Karlstad AB, Karlstad (SE)

( * ) Notice: Subject to any disclaimer, the term of this patent is extended or adjusted under 35 U.S.C. 154(b) by 191 days.

(21) Appl. No.: 10/513,584

(22) PCT Filed: May 15, 2003

(86) PCT No.: PCT/SE03/00786

§ 371 (c)(1),
(2), (4) Date: Nov. 3, 2004

(87) PCT Pub. No.: WO03/097931

PCT Pub. Date: Nov. 27, 2003

(65) Prior Publication Data

US 2006/0070709 A1 Apr. 6, 2006

(30) Foreign Application Priority Data

May 21, 2002 (SE) ..... 0201512

(51) Int. Cl.
*D21C 3/24* (2006.01)
*D21C 3/26* (2006.01)

(52) U.S. Cl. ..... 162/71; 162/17; 162/19; 162/41; 162/52; 162/68

(58) Field of Classification Search ..... 162/19, 162/68, 41, 52, 91, 17, 71
See application file for complete search history.

(56) References Cited

U.S. PATENT DOCUMENTS 2,359,543 A * 10/1944 Bransell et al. ..... 162/237
2,459,180 A * 1/1949 Richter ..... 406/53
3,298,899 A * 1/1967 Laakso ..... 162/19
3,388,038 A * 6/1968 Hander ..... 162/246
3,532,594 A * 10/1970 Richter ..... 162/19
3,586,600 A * 6/1971 Rich et al. ..... 162/237
4,436,586 A * 3/1984 Elmore ..... 162/19

(Continued)

FOREIGN PATENT DOCUMENTS

EP 157279 A1 * 10/1985

*Primary Examiner*—José A. Fortuna
(74) *Attorney, Agent, or Firm*—Rolf Fasth; Fasth Law Offices

(57) ABSTRACT

The invention concerns a simplified method for the continuous cooking of wood raw material in the form of sawdust for the production of cellulose pulp, The method does not require any thickening stages and can be carried out with a minimum of process equipment. The complete process can be established with a steaming vessel, a cooking vessel and a subsequent pressure diffuser while the sawdust is mixed with the cooking fluid to form a slurry. The slurry has a consistency that throughout the process does not exceed 20%. The maximum consistency is preferably held at a maximum consistency of about 15-17%.

8 Claims, 1 Drawing Sheet

U.S. PATENT DOCUMENTS 5,497,791 A * 3/1996 Bowen et al. ..... 131/175
5,795,438 A * 8/1998 Stromberg et al. ..... 162/52
5,882,477 A * 3/1999 Laakso et al. ..... 162/63
6,325,888 B1 * 12/2001 Miele et al. ..... 162/17
6,379,504 B1 * 4/2002 Miele et al. ..... 162/237
6,497,791 B1 * 12/2002 Baker ..... 162/246
6,551,462 B2 * 4/2003 Prough et al. ..... 162/243
6,572,734 B2 * 6/2003 Baker ..... 162/68
6,966,970 B2 * 11/2005 Snekkenes et al. ..... 162/60
2002/0026990 A1 * 3/2002 Miele et al. ..... 162/19
2002/0060024 A1 * 5/2002 Prough et al. ..... 162/246
2006/0070709 A1 * 4/2006 Snekkenes et al. ..... 162/19

* cited by examiner

METHOD FOR THE CONTINUOUS COOKING OF WOOD RAW MATERIAL FOR CELLULOSE PULP

PRIOR APPLICATION

This application is a U.S. national phase application based on International Application No. PCT/SE03/00786, filed 15 May 2003, claiming priority from Swedish Patent Application No. 02015121-1, filed 21 May 2002.

The present invention concerns a method for the continuous cooking of wood raw material in the form of sawdust for the production of cellulose pulp.

THE PRIOR ART

Sophisticated cooking methods have been developed for the conventional continuous cooking of wood raw material in the form of well-defined cut chips with a relatively small fraction of finely divided material.

These cooking methods normally comprise the initial heating of the chips by steam to a temperature of 80-120° C., after which the chips are formed into a slurry with cooking or impregnation fluid. Delignification of the chips takes place in several stages during the successive increase in temperature of the mixture to the final cooking temperature, normally 125-170° C.

Exchange and modification of the cooking fluid takes place both during the impregnation and during the delignification, and this requires the provision of efficient draining equipment with the associated withdrawal strainers, such that cooking fluid can be withdrawn and later replaced by other cooking fluid with a modified composition and/or at a different temperature. For example, a first impregnation fluid, known as black liquor impregnation, containing black liquor with a relatively high level of residual alkali (10-20 g/l) is often used, which is withdrawn when the impregnation has been completed, and is replaced with fresh cooking liquid containing fresh white liquor at levels of 80-170 g/l.

One such piece of well-established draining equipment is the top separator, which is usually arranged at the top of the digester, and which can separate the fluid in which the chips have been transported and with which they have been impregnated prior to the top separator. In this case, addition of new cooking fluid can be carried out at the outlet from the top separator. A top separator is usually not used at the top of the second digester in two-vessel hydraulic digesters.

This top separator allows the cooking to be divided into several phases, a preimpregnation before the digester and an initial establishment of the cooking fluid in the digester.

A relatively rapid consumption of alkali takes place during the initial phases of the cooking, and the concentration of alkali falls dramatically while the concentration of liberated organic material, primarily lignin, increases. Thus, the modification of the cooking fluid during the cooking is attempted such that the level of alkali is raised while the level of liberated organic material can be held at a reasonable level. This requires efficient withdrawal strainers also in the digester, where consumed cooking fluid can be withdrawn, with new cooking fluid or washing fluid being added through central pipes.

Pin chips and sawdust are normally regarded as waste products and are often burned in bark-burning furnaces. Special problems arise when cooking pin chips or sawdust since these wood raw materials contain a great deal of, or consist entirely of, finely divided wood raw material. These finely divided fractions can typically be constituted by fine matter with a particle size distribution that has a normal distribution around a diameter of 1-3 mm, which is less than one tenth of the normal chip size. In particular, serious problems arise during the cooking of sawdust when attempting to circulate and to withdraw cooking fluid through and from the bed of sawdust. There is a risk of strainers clogging, when these are used, after a very short time or during any slight disturbance in the process, and this can result in the necessity to interrupt the process in order to clean these strainers.

Cooking systems for the cooking of sawdust have been delivered in which the digester itself has been made without any strainers, and in which a strict concurrent flow is used for cooking in the digester, and in which the subsequent washing is carried out in a pressurised diffuser. This maintains the pressure of the pulp until the washing is complete.

Equipment known as an "asthma digester" has also been used when cooking sawdust. This drives the sawdust into the pocket of the sluice through a sluice feed using steam injection, to a steam phase in the upper part of the digester. The sound that is created when injecting the sawdust from the sluice feed is the reason for the characteristic name of the digester. Heating to the cooking temperature in this case takes place in the upper steam phase of the digester, through the external addition of hot steam, normally steam at an intermediate pressure, 6-12 bar. Examples of such asthma digesters are shown in Tappi's manual "Pulp and Paper Manufacture", Volume 5, 1989, pp. 166-173. The asthma digester is shown in Tappi's manual with a countercurrent washing stage at the bottom of the digester, where washing filtrate is withdrawn using central pipes equipped with strainers. These pipes penetrate the digester from the bottom.

Document U.S. Pat. No. 6,325,888 reveals a system for the cooking of sawdust in which strainers have been completely removed from the digester itself, and in which the sawdust mixture is heated to its full cooking temperature, 250-350 F (equivalent to 121-176° C.), before being fed into the cooking vessel. In order for this heating to succeed with a low consumption of steam, thickening equipment and a steam mixer are used in series. The thickening equipment first drains the sawdust mixture to a consistency of 20%-40%, before the final heating to full cooking temperature takes place in the steam mixer, before input into the cooking vessel. Following cooking in the strainerless digester, the pulp is fed to a subsequent pressure diffuser where the pulp is washed free of precipitated organic material while its pressure is maintained.

This solution, however, requires well-functioning draining equipment for the sawdust mixture, which is difficult to drain, and this places stringent requirements on the strainers and their ability to withstand clogging. Furthermore, the system is expensive and complex, since a chip bin, a feed screw with steam pre-heating, a chip pump, draining equipment, a steam mixer, a cooking vessel and a final pressurised diffuser washer are all required. This equipment is often so expensive that the cost of investment cannot be justified by the revenue that the cooking of sawdust can generate, and this means that this wood raw material cannot be used for the production of cellulose pulp.

Cooking of sawdust usually gives a cellulose pulp with a lower quality, which is often used as bulking material or as a base component for simple paper products, and this means that investment costs are very restricted if it is to be possible in any way to justify a separate process for the cooking of sawdust. Furthermore, the process must be very stable, and processes that are prone to disturbance have often been closed down if they are not capable of giving continuous function.

Aim and Purpose of the Invention

The principal aim of the invention is to cook sawdust in a continuous process in which thickening stages are not required, and which can be carried out with a minimum of process equipment. The process in this way requires the smallest possible investment.

A second aim is to establish a continuous process for the cooking of sawdust in which the system maintains the mixture at a consistency lower than 15% and in which the sawdust, which has been formed into a slurry with cooking fluid, is in all essential stages carried in a unitary flow from the formation of the slurry in the first steaming vessel until the washing of the pulp after the cooking.

A further aim is to cook the chips using a method that uses energy efficiently. This is made possible since a major part of the cooking fluid is established directly with the washing filtrate that is expelled at high temperatures during the final diffusion wash. The washing filtrate can, in one preferred embodiment, be released from pressure, with the result that the temperature falls to approximately 100° C., and released steam is used for the heating of the sawdust, whereby the heat can be better conserved than would be the case if this washing filtrate were to exchange heat with fresh, cold cooking fluid.

DETAILED DESCRIPTION OF PREFERRED EMBODIMENTS

Figure 1:
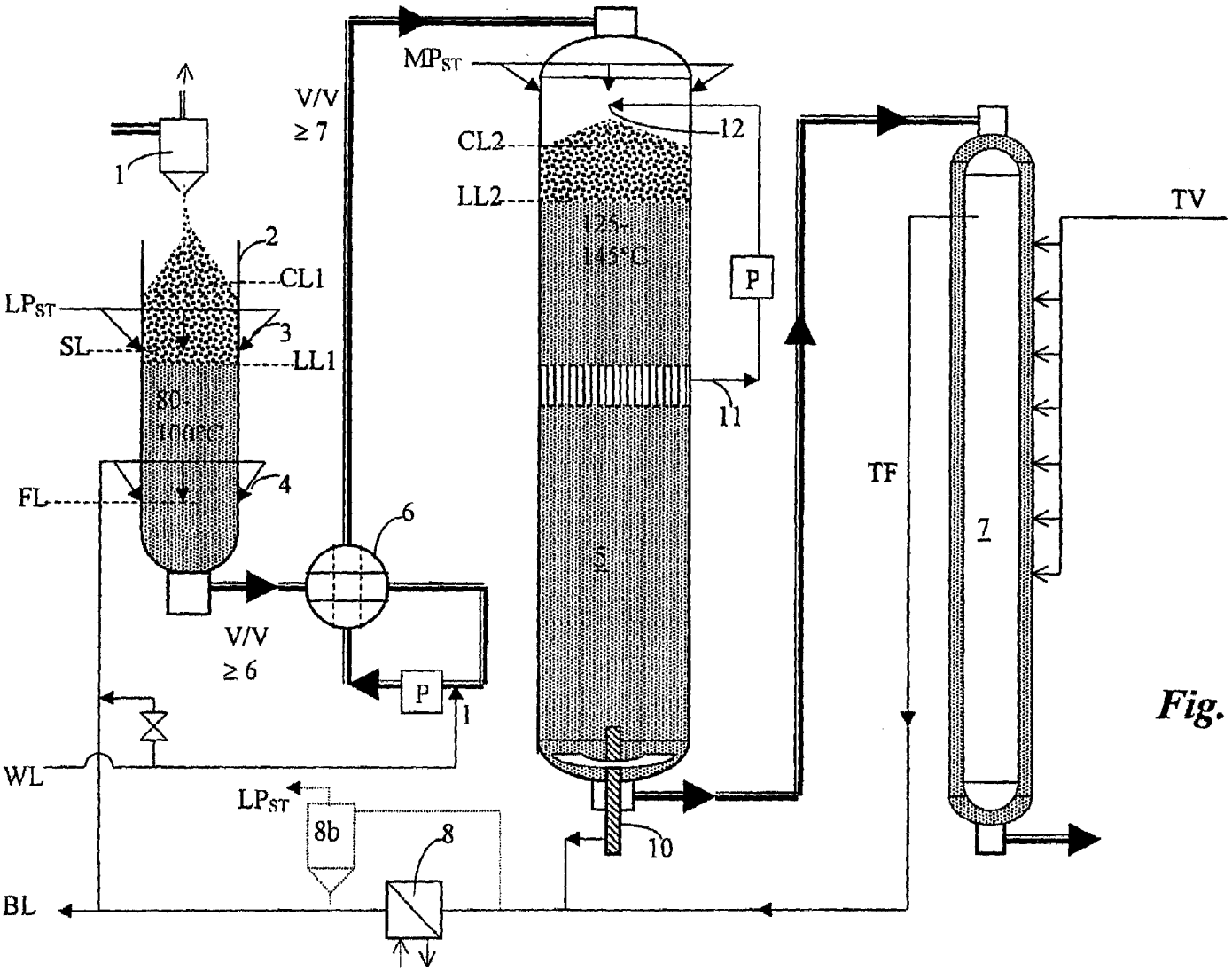
FIG. 1 shows schematically an arrangement by means of which the method according to the invention can be realised.

FIG. 1 shows a process according to the invention in which wood raw material in the form of sawdust is continuously cooked for the production of cellulose pulp.

It is appropriate that the sawdust is continuously fed to a cyclone by blowing, where air is separated upwards and the sawdust downwards to the top of a steaming vessel 2 at atmospheric pressure, preferably a steaming vessel that is open and that lacks sluices for the input of sawdust.

Steaming/heating of the sawdust with steam $LP_{ST}$ subsequently takes place in the steaming vessel 2. It is appropriate that the steam is constituted by low-pressure steam at 4-6 bar pressure above atmospheric, which is freely available at the pulp mill, and it is appropriate that the steam is supplied to the steaming vessel through injection of steam to the sawdust through nozzles 3 passing through the wall of the steaming vessel at an injection level SL that lies above the level LL1 of the cooking fluid while being below the level of the upper level CL1 of the sawdust. The steam in one preferred embodiment is constituted at least partially by the steam obtained when releasing the pressure of a washing filtrate from a subsequent washing stage. Impregnation with cooking fluid at the bottom of the steaming vessel then starts, through the addition of warm cooking fluid at the bottom of the steaming vessel 2 for impregnation of the sawdust via nozzles 4 passing through the wall of the steaming vessel at a level FL that lies below the level SL of injection of steam and under the level LL1 of cooking fluid that has been established in the steaming vessel.

A mixture of sawdust and cooking fluid is output from the bottom of the steaming vessel following impregnation with warm cooking fluid, once the sawdust, which has been mixed with cooking fluid, has been warmed in the steaming vessel to a temperature in the interval 80-110° C.

The mixture of sawdust and cooking fluid is pressurised by a pump P for transport onwards to the top of a cooking vessel 5 where a level CL2 of the sawdust is established. This level lies above a level LL2 of cooking fluid in the cooking vessel.

A conventional sluice feed 6 is shown in the arrangement shown in FIG. 1, of the type having a high-pressure tap, and having through filling pockets that can be rotated from a filling position (shown with solid lines on the pocket) to an emptying position (shown with dashed lines on the pocket). The sawdust mixture can, when the sluice is in the filling position, flow through the pocket where the sawdust mixture expels the cooking fluid that is present in the pocket, and out to the pump P. This pump returns the expelled cooking fluid under pressure to a pocket that is in the emptying position. The high-pressure tap 6 provides good insulation between the pressurised part of the system and the part at atmospheric pressure, but it can be eliminated completely in a simple embodiment of the system, being replaced by one or two pumps arranged in series.

Only when the sawdust mixture has been carried to the cooking vessel is steam $MP_{ST}$ added to the top of the cooking vessel 5 such that the sawdust that lies above the level of the cooking fluid is heated to its full cooking temperature within the interval 130-160° C. in the steam phase of the cooking vessel. The level of cooking fluid in the cooking vessel is regulated by withdrawal of cooking fluid, appropriately from the bottom of the cooking vessel, preferably, as is shown, through a withdrawal strainer in the form of a pipe that penetrates upwards through the bottom of the digester, and which warm withdrawn fluid is, at least partially, returned to the steaming vessel as is shown in FIG. 1.

The sawdust mixture before input to the cooking vessel maintains a temperature that is well below the cooking temperature in the cooking vessel, and that preferably lies at least 15° C., preferably at least 25-30° C., below the cooking temperature.

After warming of the sawdust in the steam phase to the full cooking temperature, cooking of the sawdust in the cooking fluid takes place while the sawdust falls, and the sawdust experiences a cooking time, i.e. a retention time in the cooking fluid, that lies in the interval 60-200 minutes.

After the completion of the cooking phase the sawdust mixture is fed to a pressurised diffusion washer 7 that expels cooking fluid from the sawdust using washing fluid TV while the pressure is maintained. The expelled cooking fluid forms a washing filtrate TF.

It is appropriate that the washing fluid that is used is constituted by filtrate from subsequent treatment stages, conventionally oxygen gas delignification, which washing fluid maintains a temperature of approximately 70-90° C. Following expulsion of the hot cooking fluid, which has a temperature of 130-160° C., a washing filtrate TF is obtained, which has an elevated temperature of approximately 120-145° C.

If the temperature of the pulp in the diffusion washer 7 is approximately 150° C., and if 12 $m^3$ of washing fluid at a temperature of 80° C. is used during washing to expel 10 $m^3$ of warm cooking fluid from the pulp (with no change in concentration), then the washing filtrate will be at a temperature of approximately 138° C. ($10*150+2*80=12*X \Rightarrow X=138$).

This washing filtrate is led to the steaming vessel 2 where it is added to the sawdust at this elevated temperature. If required, the washing filtrate TF obtained can first be cooled, either in a heat exchanger 8 and/or through a release of pressure in a cyclone 8*b*. The heat exchanger can be, as is shown in the figure, an indirect heat exchanger that is cooled by cold water.

In order to obtain a cooking process with a good energy economy, steam from the cyclone 8*b* is used as heating steam in the steaming vessel 2, and at least part of the total amount of washing filtrate from the diffuser 7 is led directly to the steaming vessel to form a part of the cooking fluid.

The washing filtrate TF constitutes a fraction of the total amount of cooking fluid in excess of 50%, and preferably in an amount equivalent to 3.5-6 tonnes, preferably approximately 5 tonnes, of washing filtrate per tonne of sawdust.

White liquor WL is added to the steaming vessel 2 and, where appropriate, also during pumping to the cooking vessel, in order to form part of the total cooking fluid. The amount of white liquor required is equivalent to 1-2.5 tonnes of white liquor per tonne of sawdust.

The complete addition of washing filtrate, white liquor and steam condensate allows the establishment of a fluid/wood ration (F/W) that has the following values at different locations in the system:

on exit from the steaming vessel⇒F/W≧6.0 (equivalent to a concentration just over 16%)

on input to the cooking vessel⇒F/W≧7.0 (equivalent to a concentration just over 14%);

on exit from the cooking vessel⇒F/W≧6.0 (equivalent to a concentration just over 16%).

The calculation above is based on the original wood content, and since the pulp is delignified during the cooking and the released organic material (principally lignin) is withdrawn for recovery, the actual concentration on exit from the cooking vessel will be significantly lower (a concentration of 9.6% for a yield of 60% from the cooking phase).

This corresponds, at a fluid/wood ration of 7.0, to:

approximately 1 tonne condensate per tonne sawdust approximately 1 tonne white liquor per tonne sawdust approximately 5 tonnes washing filtrate (black liquor) per tonne sawdust.

The large amount of black liquor that is returned at an elevated temperature to the steaming vessel ensures a very good energy economy for the process, and essentially only the sawdust (usually having the temperature of the surroundings, 20° C.) and the white liquor (which, however, normally has a temperature of 70-85° C.) need to be heated.

The consistency of the sawdust, in a slurry formed with cooking fluid, is maintained during the complete process such that it does not exceed 20%, and it is appropriate that it is held at a maximum level in the interval 15%-17%. From the point of view of process technology, the low consistency ensures a system that is easy to manage with a minimum of interruptions of the process. A significant characteristic of the process is that more than 95%, and preferably 100%, of the cooking fluid that is added to the sawdust from the initial mixing with cooking fluid until it is transferred to the digester accompanies the sawdust in a mixture of cooking fluid and sawdust right up until the cooking is completed in the cooking vessel.

The invention can be modified in a number of ways within the framework of the accompanying claims. For example, a simple strainerless flow 11 can be used in the cooking vessel, where the cooking fluid and a small amount of accompanying sawdust can be returned to the top of the cooking vessel. Such a simple flow can be designed without restrictions that run the risk of becoming clogged, and, by arranging the outlet 12 to lie above the established upper surface of the sawdust, the returned cooking fluid and the sawdust can be distributed without restriction in the digester.

While the present invention has been described in accordance with preferred compositions and embodiments, it is to be understood that certain substitutions and alterations may be made thereto without departing from the spirit and scope of the following claims.

The invention claimed is:

1. A method for the continuous cooking of wood raw material in the form of sawdust for the production of cellulose pulp, comprising;

continuously feeding sawdust to a top of a steaming vessel, steaming/heating the sawdust with steam in a steaming vessel, adding a washing filtrate to the steaming vessel, the washing filtrate forming a cooking fluid, the cooking fluid heating the sawdust to a temperature of 80-100° C., impregnating the sawdust with a cooking fluid at a bottom of the steaming vessel, discharging a mixture of sawdust and cooking fluid from the bottom of the steaming vessel, more than 95% of the cooking fluid added to the sawdust accompanying the sawdust in the mixture of the cooking fluid and the sawdust;

pressurizing the mixture by a pump for transporting the mixture onwardly to a top of a cooking vessel without further heating of the sawdust, transferring the mixture to the cooking vessel without draining any cooking fluid from the sawdust;

establishing a level of the sawdust in the cooking vessel that is above a level of the cooking fluid in the cooking vessel, in a steam phase, adding steam to the top of the cooking vessel to heat the sawdust with steam while the sawdust falls through the steam phase at the top of the cooking vessel and heating the sawdust that lies above the level of the cooking fluid to a cooking temperature within a temperature interval of 130-160° C., cooking the sawdust in the cooking fluid for a cooking time within a time interval of 60-300 minutes, discharging the sawdust and the cooking fluid to a pressurized diffusion washer, expelling the cooking fluid from the sawdust by using a washing fluid while a pressure is maintained, the expelled cooking fluid forming a washing filtrate, adding white liquor to the steaming vessel, and forming the sawdust into a slurry in the steaming vessel with the cooking fluid so that a consistency of the slurry is 20% or less.

2. The method according to claim 1 wherein the washing filtrate is added to the steaming vessel through a pressure-reducing cyclone from which steam is obtained.

3. The method according to claim 2 wherein the sawdust mixed with the cooking fluid at a bottom of the steaming vessel.

4. The method according to claim 3 wherein the sawdust mixed with the cooking fluid is given a temperature that is at least 15 C below the cooking temperature before being fed into the cooking vessel.

5. The method according to claim 3 wherein the level of the cooking fluid in the cooking vessel is regulated by a withdrawal of cooking fluid from the bottom of the cooking vessel, and at least part of the withdrawn fluid is returned to the steaming vessel.

6. The method according to claim 3 wherein the steaming/heating of the sawdust with steam in the steaming vessel takes place through injection of steam to the sawdust via nozzles passing through a wall of the steaming vessel at an injection level that is above the level of cooking fluid and below an upper level of the sawdust.

7. The method according to claim 6 wherein the addition of cooking fluid at the bottom of the steaming vessel for impregnation of the sawdust takes place through nozzles through the wall of the steaming vessel that is disposed below the injection level for the injection of steam and below the level of cooking fluid established in the steaming vessel.

8. The method according to claim 1 wherein 100% of the cooking fluid is added to the sawdust in the steaming vessel.

* * * * *